United States Patent [19]

Kallestad et al.

[11] 3,943,924

[45] Mar. 16, 1976

[54] MOUTHPIECE

[75] Inventors: Steven B. Kallestad, Minneapolis; Robert H. May, Wayzata, both of Minn.

[73] Assignee: Northstar Athletic Industries, Inc., Minneapolis, Minn.

[22] Filed: Sept. 30, 1974

[21] Appl. No.: 510,788

Related U.S. Application Data

[63] Continuation of Ser. No. 432,582, Jan. 11, 1974, abandoned, which is a continuation of Ser. No. 346,852, April 2, 1973, abandoned, which is a continuation of Ser. No. 200,250, Nov. 18, 1971, abandoned, which is a continuation of Ser. No. 755,185, Aug. 26, 1968, abandoned.

[52] U.S. Cl. ..... 128/136

[51] Int. Cl.[2] ..... A61F 5/58; A61C 11/00

[58] Field of Search ..... 128/136, 133, 137, 132; 32/2, 5, 7

[56] References Cited

UNITED STATES PATENTS

| | | | |
|---|---|---|---|
| 2,630,117 | 3/1953 | Coleman | 128/136 |
| 2,643,652 | 6/1953 | Cathcart | 128/136 |
| 3,124,129 | 3/1964 | Grossberg | 128/136 |
| 3,207,153 | 9/1965 | Goldstein | 128/136 |
| 3,223,085 | 12/1965 | Gores et al. | 128/136 |
| 3,411,501 | 11/1968 | Greenberg | 128/136 |

FOREIGN PATENTS OR APPLICATIONS

| | | | |
|---|---|---|---|
| 480,423 | 8/1929 | Germany | 128/138 |

*Primary Examiner*—Aldrich F. Medbery
*Attorney, Agent, or Firm*—Merchant, Gould, Smith, Edell, Welter & Schmidt

[57] ABSTRACT

An athletic mouthpiece of a composite construction is provided which has a relatively flexible, shock absorbing material in which is permanently imbedded a relatively rigid insert located to provide a backing for the upper front teeth. The insert, which in use is situated adjacent the lingual surfaces of the upper front teeth and at least a portion of the palate, aids in delocalizing the forces which penetrate the more flexible material, thereby preventing the concentration of forces in a small area which could result in oral injury.

12 Claims, 1 Drawing Figure

INVENTORS
STEVEN B. KALLESTAD
ROBERT H. MAY
BY Franklin J. Kroll
ATTORNEY

MOUTHPIECE

This is a continuation of application Ser. No. 432,582, filed Jan. 11, 1974, which was a continuation of prior application Ser. No. 346,852, filed on Apr. 2, 1973, which was a continuation of prior application Ser. No. 200,250, filed on Nov. 18, 1971, which was a continuation of prior application Ser. No. 755,185, filed on Aug. 26, 1968 all now abandoned.

This invention relates to a mouthguard for protecting the teeth and related oral structures from damage due to shock.

Protective athletic mouthpieces generally fall in one of three classes - (1) the non-personalized, universal type; (2) the direct-formed type which is fitted within the user's mouth by direct contact; and (3) the custom type formed from a cast of the user's mouth.

This invention primarily relates to the latter type although its principles could be utilized in either of the first two classes. The cast-formed type allows the technician to manipulate the material without interference and in temperature ranges and chemical environments which are not minimized by the subject. Thus, this type is invariably better fitting, insuring greater protection with minimum breathing and speech interference. The cast-formed type of protection is recommended by dental experts.

The universal type requires closed jaws to hold it in place. Even then it is loose and cumbersome and speech and breathing interference is maximized. The direct-formed type is a vast improvement over the universal type; however, it too suffers from certain disadvantages occasioned by the fact that it is fitted directly in the mouth where it is difficult to properly shape and contour the material before it sets up. Uneven thickness is a particular problem with this mouthpiece type.

Whatever be the particular type of mouthpiece employed, the materials from which they are made are generally flexible to provide the shock absorbing properties which are needed. However, it has now been discovered that significantly greater protection can be achieved by the combination with the flexible, shock absorbing material of a rigid, backing support which will transmit the forces created by the blow and initially absorbed by the flexible material, thereby insuring decentralization of the forces rather than their localization at a point which would be damaged thereby.

The function of the rigid backing material may be understood from the following analogy. If an object such as a stick which is anchored in cement is struck with a blow, the force will be absorbed by the stick at the point of the blow and, if great enough, cause the stick to break, generally at the cement line. Similarly, if the same stick is braced from behind, the equivalent blow will be transmitted throughout the length of the stick thereby reducing the magnitude of the force over any point. Teeth represent the stick in the analogy; the supporting bone and periodontal ligaments represent the cement. As has now been discovered, the dual provision in a protective mouthpiece of a relatively flexible, shock, absorbing material and a more rigid force transmitting material provides the optimum in tooth protection. As stated above, while this combination of shock absorbing and force transmitting materials can be utilized in all three classes of protective mouthpieces, the recognized advantages of the cast-formed type make it the preferred one for purposes of this invention.

In order to promote a fuller understanding of this invention, the attached drawings are provided, wherein.

Figure 1:
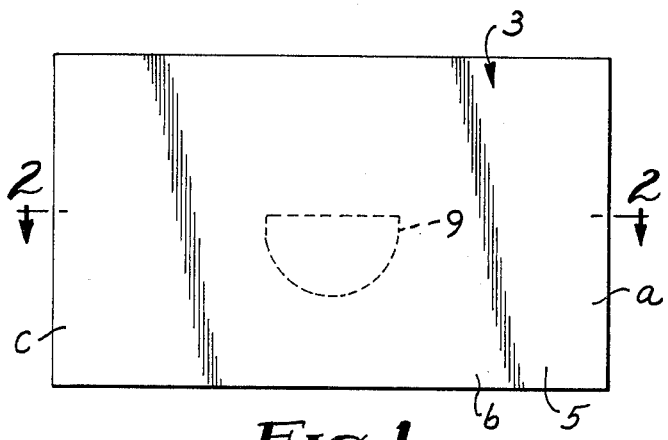
FIG. 1 is a top view of the structure from which the mouthpiece of this invention is constructed.
Figure 2:
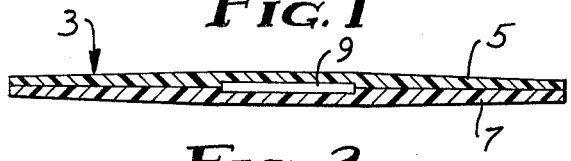
FIG. 2 is a sectional view taken along line 1-1 of FIG. 1.
Figure 3:
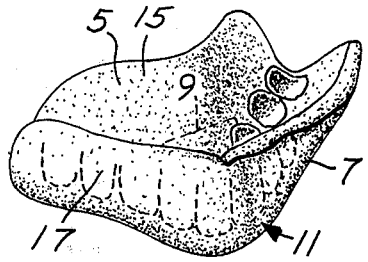
FIG. 3 is a perspective view of the mouthpiece of this invention.

Referring to FIGS. 1 and 2, a blank designated by the numeral 3 is composed of a pair of sheets 5 and 7 of a flexible, shock absorbing material between which is interposed a backing plate or insert 9 of a force transmitting, rigid material (as compared to the material of sheets 5 and 7). The insert 9 is preferably arcuate shaped as in the finished structure it will be located adjacent the lingual surface of at least the central incisors (see FIG. 5 and 6) and preferably adjacent at least the hard palate portion of the upper mouth as well (see FIG. 5). The individual sheets 5 and 7 are preferably of the same thickness. It is to be understood that only one sheet of flexible, shock absorbing material need be employed in combination with the relatively rigid, force transmitting material, in which case the latter material would be in direct contact with the lingual surfaces of the teeth rather than spaced therefrom by a thickness of one sheet of the shock absorbing, more flexible material.

The blank 3 can be prepared by making a sandwich of the sheets 5 and 7 with the insert 9 interposed in a generally central location, and heating the sandwich structure with coincident or subsequent compression to provide a blank wherein the top and bottom sheets are well bonded to one another with the insert securely located inbetween. In practice, the sheets 5 and 7 are subjected to conditions of heat and pressure which cause the two sheets to flow together at the interface so that a bond line is not distinguishable.

Since the rigid insert 9 will preferably be located only adjacent the lingual surface of the teeth as well as the hard palate, it is located in blank 3 a sufficient distance from three adjacent edges (*a*, *b*, *c*, for example) of blank 3 so that an ample amount of flexible, shock absorbing material is present for the labial as well as the incisal and occlusal (biting) surfaces of the teeth. While the presence of the flexible, shock absorbing material on the labial and biting surfaces is not essential, it is considered preferably as possible protection against damage to the temporal mandibular joint.

Figure 6:
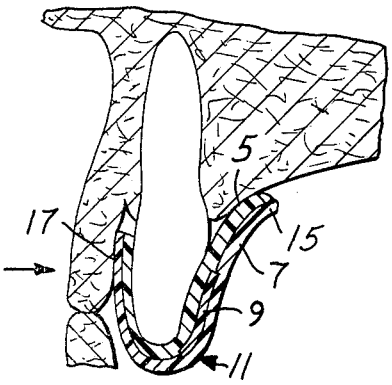
FIG. 6 is a sectional view of FIG. 4 taken along line 6—6.

FIGS. 3–6 illustrate a mouthpiece 11 consisting of an elongated shell of essentially U-shaped cross section, the shell being arcuately formed over its length to fit over a row of teeth. The U-shaped cross section of the shell is defined by an inner (lingual) upstanding portion 16, an outer (labial) upstanding portion 17 and a connecting portion 18 which overlies the biting (occlusal and incisal) surfaces of the user's teeth. The rigid backing plate or insert 9 is completely embedded in the inner upstanding portion 16 in a central position of the arcuate length thereof (FIG. 5) so that it will lie adjacent the lingual surfaces of the user's teeth when the mouthpiece 11 is properly positioned. In this embodiment, the inner upstanding portion 16 projects beyond the force transmitting insert 9 upwardly and away from the outer upstanding portion 17 to form a palatal portion 15 for overlying at least a part of the user's hard palate, as shown in FIG. 6. In this preferred embodiment, the mouthpiece is designed to extend only as far back as the second bicuspids 19 (FIG. 5), and the insert plate 9 is shorter than the arcuate length of the inner upstanding portion 16. Protection beyond that point is generally not needed due to the protection afforded by the buccal fat pad in the cheek. Thus, there is no necessity for carrying the length of the protective mouthpiece to cover the molars as most mouth protectors are now constructed. Also, posterior to the upper molars is a gag reflex; activating this can be eliminated with a shorter mouthpiece without sacrificing the necessary protection. A further advantage of this design is that bicuspid teeth are the most bell-crowned teeth in the mouth; by carrying the design only to include the bicuspids, good retention will be attained while reducing gagging problems.

Figure 4:
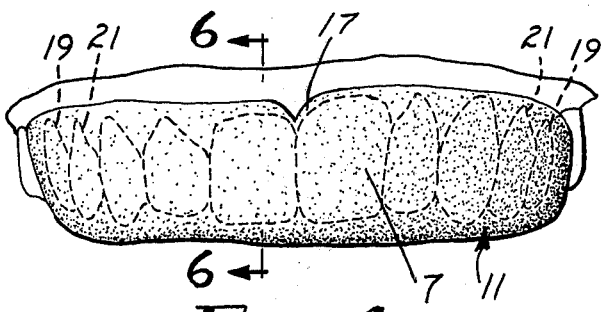
FIG. 4 is a front elevational view of a mouthpiece according to this invention.
Figure 5:
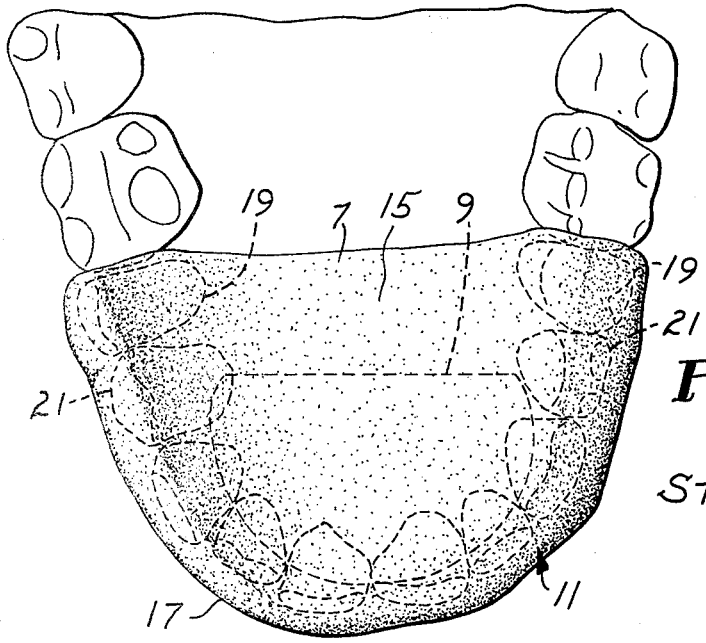
FIG. 5 is a top view of a mouthpiece according to this invention.

Referring to FIGS. 4 and 5, the positioning of the mouthpiece with respect to the mouth is shown. The mouthpiece extends along the biting surface to the second bicuspids 19 as mentioned above.

Referring to FIG. 6, this sectional view illustrates the manner in which the flexible, shock absorbing surface 11 conforms to the shape of the tooth while the more rigid, force transmitting insert 9 reinforces the shock absorbing surface 11 in the region of the lingual surface of the tooth, with a portion preferably extending rearward therefrom along a portion of the hard palate. The force of a blow struck along the direction of the arrow is thus initially absorbed by the mouthpiece adjacent the labial surface of the tooth and then diffused along the entire upper set of teeth as well as the mouthpiece by the rigid insert 9.

Whereas the force transmitting material should be relatively rigid at body temperature and the shock absorbing material relatively flexible at such temperature, it is a general requirement that each be relatively flexible at an elevated temperature (between 90°–200°C.) so that the blank composite can be readily molded to conform to the shape of the cast of the upper mouth. Preferably, both materials should be biologically inert and tasteless. Clear resinous materials are likewise preferred. These physical requirements are met by the combination of polyvinyl chloride polymers for the rigid, force transmitting material and copolymers of ethylene, especially ethylene and vinyl acetate, for the more flexible, shock absorbing material.

In general, the mouthpiece is prepared from a blank such as is illustrated in FIGS. 1 and 2 by first heating the blank until it acquires overall flexibility sufficient to be molded around a plaster cast of the upper mouth, then the heated blank placed over the plaster cast and a vacuum drawn which is sufficient to draw the blank tightly around the cast. After the blank has been shaped, the cast with the shaped blank in place is cooled, the mouthpiece trimmed to the desired shape, and removed.

The following non-limiting example is provided to gain a better understanding of the invention.

EXAMPLE

A blank is formed by placing a 0.03 in. thick insert of polyvinyl chloride which is semi-circular in shape (0.75 in. diameter) between two one-sixteenth inch thick sheets (5 in. wide and 5 in. long) of ethylene/vinyl acetate copelymer. The structure is then heated to about 120°C. and compressed between platens at a pressure of about 10 psi for ten minutes to fuse the two ethylene-vinyl acetate sheets together and secure the polyvinyl chloride insert inbetween. As a result, the overall thickness of the blank is about 0.125 in.

The mouthpiece is prepared by first heating the blank in boiling water (100°C.) for about 1 minute. A cast of the subject's upper mouth is placed on a vacuum box, teeth extending upward, and the heated blank placed over the biting surface of teeth, making sure that the insert material will be drawn into the hard palatal area. A vacuum sufficient to draw the blank around the teeth and palatal areas of the cast is then pulled. Vacuum drawing can be supplemented or replaced with manual pressure to effect molding of the blank to the desired shape. After the desired shape is achieved, the cast and mouthpiece are cooled, trimmed to size and the mouthpiece removed.

An alternative procedure for making the blank from which the mouthpiece is prepared is to suspend the rigid insert in a mold and then inject the flexible material into the mold to form the blank.

The mouthpiece of this invention provides maximum protection to all tooth surfaces in the areas where needed, minimizes speech and breathing difficulties, eliminates gagging, and provides excellent retention. The materials of which it is constructed are readily available and present no toxicity or taste problems.

What is claimed is:

1. A protective mouthpiece comprising:

a. an elongated shell of flexible, shock absorbing polymeric material having an essentially U-shaped cross section defined by inner and outer upstanding portions and a connecting portion, the shell being arcuately formed over its length to fit over a row of teeth, said outer and inner upstanding portions and said connecting portion adapted to respectively overlie the outer, inner and biting surfaces of a user's teeth;

b. and an insert plate member of rigid, force transmitting material disposed in the inner upstanding portion only and completely embedded in a central position of the arcuate length thereof to lie adjacent said inner tooth surfaces when the mouthpiece is placed in the user's mouth.

2. The mouthpiece defined by claim 1, wherein the insert plate is generally semicircular in shape.

3. The mouthpiece defined by claim 1, wherein the length of the insert plate is substantially less than the arcuate length of said inner upstanding portion.

4. The mouthpiece defined by claim 1, wherein:

a. said arcuate shell comprises a laminate formed from first and second thin sheets of said polymeric material;

b. and said insert plate member is disposed between said first and second thin sheets of polymeric material.

5. The mouthpiece defined by claim 1, wherein said polymeric material and said rigid, force transmitting material become conformably flexible at elevated temperatures to permit molding thereof into a desired shape.

6. The mouthpiece defined by claim 5, wherein the arcuate shell comprises a copolymer of ethylene and vinyl acetate, and the insert plate member comprises a polyvinyl chloride resin.

7. The mouthpiece defined by claim 1, which further comprises a palatal portion projecting upwardly and away from the outer upstanding portion for overlying at least a part of the user's hard palate with the mouthpiece in place.

8. A protective mouthpiece comprising:

a. an elongated laminate shell formed from first and second thin sheets of flexible, shock absorbing polymeric material, the shell having an essentially U-shaped cross section defined by inner and outer upstanding portions and a connecting portion, the shell being arcuately formed over its length to fit over a row of teeth, said outer and inner upstanding portions and said connecting portion adapted to respectively overlie the outer, inner and biting surfaces of a user's teeth;

b. an insert plate member of rigid, force transmitting material disposed in a central position of the arcuate length of the inner upstanding portion between said first and second thin sheets of polymeric material to lie adjacent said inner tooth surfaces when the mouthpiece is placed in the user's mouth;

c. said polymeric material and said rigid, force transmitting material being conformably flexible at elevated temperatures to permit molding thereof into a desired shape.

9. The mouthpiece defined by claim 8, wherein the insert plate is generally semicircular in shape.

10. The mouthpiece defined by claim 8, wherein the length of the insert plate is substantially less than the arcuate length of said inner upstanding portion.

11. The mouthpiece defined by claim 8, wherein the arcuate shell comprises a copolymer of ethylene and vinyl acetate and the insert plate member comprises a polyvinyl chloride resin.

12. The mouthpiece defined by claim 8, which further comprises a palatal portion projecting upwardly and away from the outer upstanding portion for overlying at least a part of the user's hard palate with the mouthpiece in place.

* * * * *